United States Patent [19]

Pate

[11] 4,337,883

[45] Jul. 6, 1982

[54] SKATEBOARD HOLDER

[76] Inventor: John R. Pate, 401 S. Barrington, Apt. 106, Los Angeles, Calif. 90049

[21] Appl. No.: 207,649

[22] Filed: Nov. 17, 1980

Related U.S. Application Data

[63] Continuation-in-part of Ser. No. 47,164, Jun. 11, 1979, abandoned.

[51] Int. Cl.[3] ..... A45C 11/24

[52] U.S. Cl. ..... 224/250; 224/253

[58] Field of Search ..... 224/214, 224, 226, 240, 224/250, 252, 253, 255, 256

[56] References Cited

U.S. PATENT DOCUMENTS

| | | | |
|---|---|---|---|
| 601,982 | 4/1898 | Peirson | 224/255 X |
| 702,398 | 6/1902 | Bowyer | 224/250 |
| 755,009 | 3/1904 | Igel | 224/250 |
| 792,126 | 6/1905 | Freund | 224/250 |
| 2,524,639 | 10/1950 | Saunders | 224/250 X |
| 2,654,514 | 10/1953 | Jensen | 224/250 |
| 3,032,294 | 5/1962 | Zeabari | 224/250 X |
| 3,148,812 | 9/1964 | Hilsinger, Jr. | 224/250 |
| 3,401,857 | 9/1968 | Wilson et al. | 224/214 |
| 3,583,611 | 6/1971 | Theodore | 224/250 X |

*Primary Examiner*—Stephen Marcus
*Attorney, Agent, or Firm*—Freilich, Hornbaker, Wasserman, Rosen & Fernandez

[57] ABSTRACT

A skateboard holder which can be removably attached to the belt of a wearer for transporting a skateboard. More specifically, a skateboard holder is disclosed having a rectangularly-shaped hanger, formed of a flat material such as leather, in which two vertically oriented slits are formed in an upper portion thereof for attachment to a belt. Attached to two side portions of the hanger are two straps having fastening means at their end portions so that a loop defined by the straps and hanger can be formed. The straps are formed so that each one attaches to the hanger along a predetermined length of a vertical edge thereof. Each strap tapers down so that its end portion is narrower than the predetermined length. This allows the weight of the skateboard to be supported while at the same time allowing the skateboard to be positioned as low as possible for wearer comfort. A vertically oriented skateboard having its upper wheels extending outwardly is positioned against the hanger so that a loop formed by the two straps is under the outwardly-extending upper wheels, thereby providing support for the skateboard as it is transported. In a further embodiment of the invention, a single strap extending from one side portion of the holder is provided. The end portion of the single strap is attached to the other side of the hanger so as to form a loop for holding the skateboard as in the first embodiment.

10 Claims, 5 Drawing Figures

FIG. 1
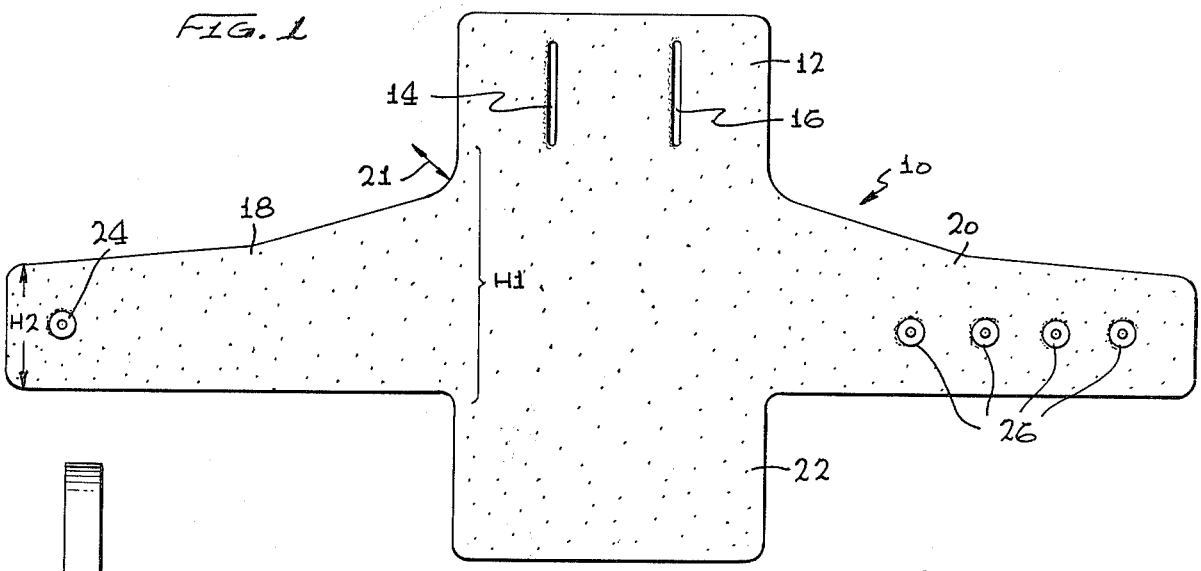
FIG. 2
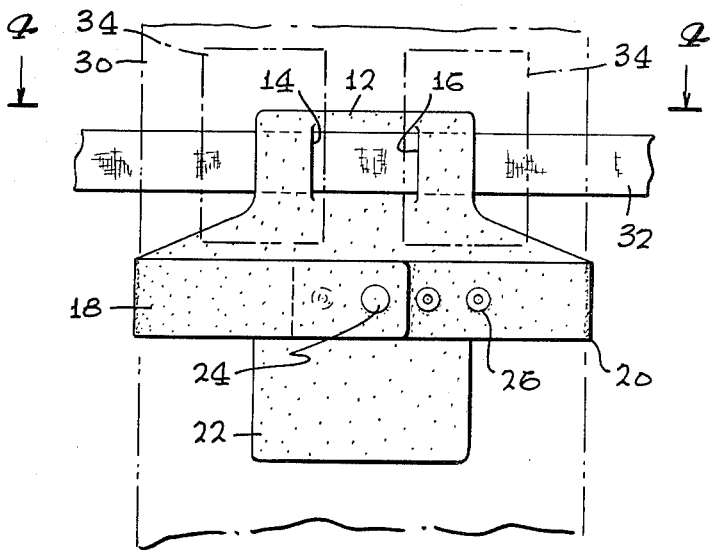
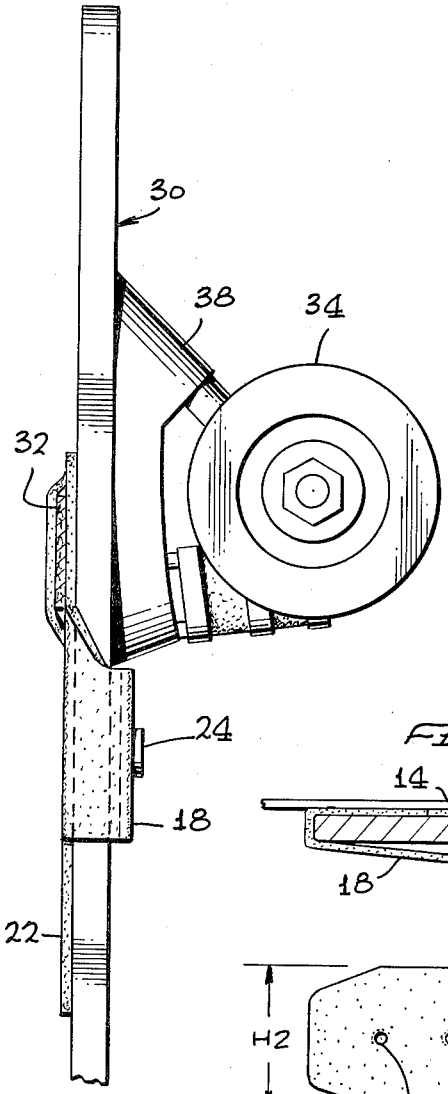
FIG. 3
FIG. 4
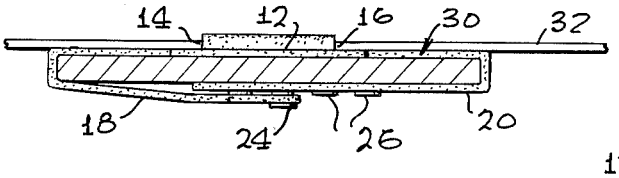
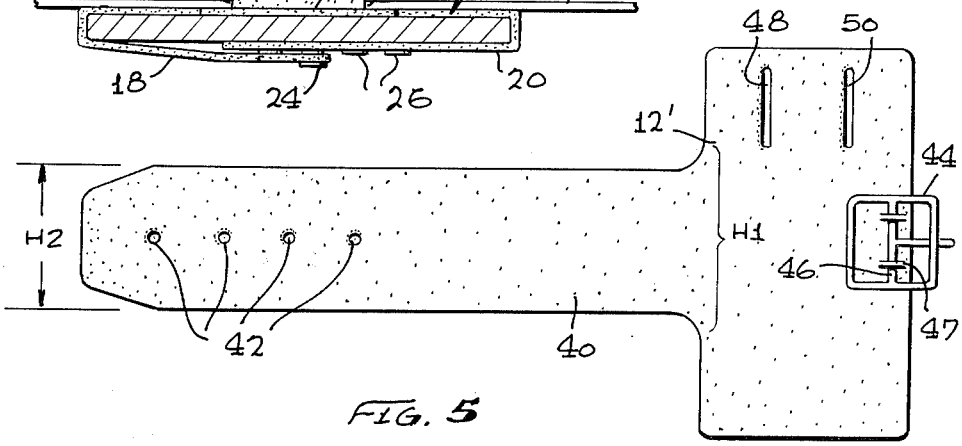
FIG. 5

SKATEBOARD HOLDER

This application is a continuation-in-part of application Ser. No. 047,164, filed June 11, 1979, now abandoned.

BACKGROUND OF THE INVENTION

The invention relates to skateboard holders for attachment to the clothing of a user.

The popularity of skateboarding is rapidly increasing, and is expected to continue to increase as more people become aware of its advantages as a sport. Concurrent with its use as a sport, it is also becoming more and more used as a transportation means for such diverse activities as errand running, shopping and the like. However, conventional skateboards are somewhat elongated, heavy and awkward to carry. A problem in using skateboards as a transportation means is what to do with them once having arrived at a desired destination. Skateboard users are frequently seen carrying their skateboards in both arms after having arrived at their destination. There has long been a need for a means by which a skateboard user can easily and conveniently carry his skateboard when not in use, thereby allowing both arms to be free for other purposes. The skateboard holder provided by the present invention solves this problem by providing a means by which the skateboard can be conveniently carried by a user when not in use.

SUMMARY OF THE INVENTION

The present invention provides a skateboard holder comprising a hanger incorporating a means for removable attachment to a belt of a wearer. Attached to the hanger is a strap means which can be removably positioned around a vertically oriented skateboard and below the upper wheels thereof. The strap means is wider at the end attached to the hanger than at the portion positioned below the skateboard upper wheels. Included is a means for forming a closed loop comprised of the hanger and the strap means so that a vertically oriented skateboard can be supported by the closed loop. In one embodiment of the invention, the hanger is formed in a rectangular shape, and two straps extend from vertical edge portions of the hanger. The straps have a fastening means attached to their end portions so that a loop formed by the hanger and the two straps can have different diameters to accommodate different size skateboards. In another embodiment of the invention, a single strap extending from one vertical edge portion of the hanger is provided. A fastening means is provided on an end portion of the strap and on the hanger so that the strap can be attached to the other edge portion of the hanger. Specific attachment means disclosed include a snap means and a buckle means.

BRIEF DESCRIPTION OF THE DRAWINGS

FIG. 1 shows a skateboard holder provided by the invention;

FIG. 2 is a front view showing the skateboard holder of FIG. 1 attached to a belt and supporting a skateboard;

FIG. 3 is a side view of the skateboard holder of FIG. 1 showing positioning of the supporting straps under the upper wheels of the skateboard;

FIG. 4 is a view taken along lines 4—4 of FIG. 3; and

FIG. 5 shows a further embodiment of the skateboard holder provided by the invention.

DETAILED DESCRIPTION

Detailed illustrative embodiments of the invention disclosed herein exemplify the invention and are currently considered to be the best embodiments for such purposes. However, it is to be recognized that changes in the specific form of the invention, as herein described, may be made without departing from the spirit of the invention. Accordingly, the specific embodiments disclosed are only representative in providing a basis for the claims which define the scope of the present invention.

As previously explained, the invention provides a skateboard holder which can be removably attached to a wearer's belt, and which incorporates strap means which can be fastened around and under the upper wheels of a vertically oriented skateboard for support thereof.

Referring to FIG. 1, a skateboard holder 10 includes a rectangularly-shaped hanger 12. At the upper portion of the hanger 12 are two vertically oriented slits 14 and 16 through which a wearer's belt can be slipped for support of the skateboard holder 10. A first strap 18 extends outwardly from one side portion of the holder 12 and a second strap 20 extends outwardly from the other side portion. The straps are configured so that the width H1 where the strap 18 attaches to the hanger 12 is wider than the end portion width H2. In this particular embodiment $H1 \approx 2H2$. The purpose of this important feature is to maximize the support where the strap attaches to the hanger 12 to accommodate the weight of the skateboard, while allowing the skateboard to hang as low as possible in the holder 10 for wearer comfort. Thus the skateboard weight which can be supported is related to the width H1, and the position of the skateboard with respect to the holder 10 is related to the width H2. Although the exemplary embodiment shows $H1 \approx 2H2$, other ratios could be chosen so long as H1 is greater than H2. Also, the straps 18 and 20 attach to the hanger 12 along a radius as shown at 21, thereby reducing a tendency for the strap to tear away from the hanger 12 due to the skateboard weight. The rectangularly-shaped hanger 12 is configured so that the longer dimension is vertically oriented, thereby providing a downwardly extending lower portion indicated at 22 for convenience in supporting the skateboard and protection against rubbing of a leg or trouser of the wearer by the skateboard. Snaps are provided on end portions of the first and second straps 18 and 20, respectively, the male snap 24 being attached to the end portion of the first strap 18 and a plurality of female snaps 26 being attached to an end portion of the second strap 20. The plurality of female snaps 26 are provided so that a loop defined by the hanger 12 and the first and second straps, 18 and 20, respectively can be adjusted to accommodate various skateboard widths. As can be seen in FIG. 1, the hanger 12 and straps 18 and 20 are formed from a single sheet-like material, which could be leather, a flexible plastic material, or the like. However, as can be readily appreciated, it is not necessary that the straps and hanger be formed from a single sheet. The straps could be separately formed and attached to the hanger in a variety of ways. Other means for attaching the skateboard holder to a belt could also be utilized. For example, loops could be formed in the back or front instead of the two slits, 14 and 16, the loops being adapted so that a belt could be positioned therein. Also, the two strap end portions could be attached by other than snap means, such as by a buckle, lace, or any other means capable of supporting the weight of the skateboard.

A skateboard 30 positioned in the skateboard holder 10 is shown in FIG. 2. A belt 32 is shown inserted through the vertically oriented slits 14 and 16. The upper wheels 34 of the skateboard 30 abut against the two straps 18 and 20 and are supported thereby when the strap end portions are fastened to each other. A side view and top view of the skateboard 30 supported by the skateboard holder 10 can be seen in FIGS. 3 and 4, respectively. As can be seen, a support bracket 38 supporting the wheels 34 abuts against the support straps 18 and 20. Some skateboards have a platform upon which the support bracket 38 is mounted. For this type of skateboard, either the platform or the support bracket 38 could abut against the holding straps 18 and 20, depending upon the diameter of the loop formed by the hanger 12 and the two straps 18 and 20.

A further embodiment of the invention is shown in FIG. 5. In this embodiment, a hanger 12' is provided. A single strap 40 extends from one side portion of the hanger 12', the end portion of which forms a plurality of holes 42. The other side portion of the hanger 12' has a buckle 44 attached thereto, a central cross member 46 of which is attached to the hanger 12' by any suitable attachment means such as a heavy duty thread 47. Two vertically oriented slits 48 and 50 are provided for attachment to a belt as in the first embodiment. As in the first embodiment, the strap width H1 where it attaches to the hanger 12' is greater than the width H2 at the unattached end.

In operation, the skateboard is positioned with respect to the holder 12' as in the first embodiment so that the holding strap 40 can be positioned under the upper wheels of a vertically oriented skateboard. The end portion of the strap 42 is then positioned in the buckle 44 in a conventional manner so that a loop will be formed by the strap 42 and hanger 12' under the skateboard wheels, thereby supporting it.

Thus, as one can appreciate, a skateboard holder has been described which can be attached to a wearer's belt and provides a strap means which, in conjunction with a hanger, can form an adjustable loop underneath the upper wheels of a vertically oriented skateboard so that the skateboard can be conveniently carried when not in use.

What is claimed is:

1. A skateboard holder comprising:

a hanger;

means for removably attaching said hanger to a belt;

strap means depending from at least one vertical edge of said hanger and adapted to be removably positioned under the upper wheels of a skateboard when said skateboard is vertically oriented and positioned against said hanger so that its wheels extend outwardly from said hanger, said strap means being wider along said at least one vertical edge from which it is dependent than at the portion positioned under said skateboard upper wheels; and means for fastening said strap means when positioned under said skateboard upper wheels, said means for fastening being adapted to support the weight of said skateboard.

2. A skate board holder comprising:

a hanger having means for attachment to a belt of a wearer, said means for attachment being adapted to support the weight of a skateboard;

a first strap having first and second ends, said first end being wider than said second end, said first strap first end being attached to one side of said hanger;

a second strap having first and second ends, said first end being wider than said second end, said second strap first end being attached to the other side of said hanger; and means for interconnecting said first and second straps when positioned under said skateboard upper wheels, whereby said upper wheels are supported by said strap second ends.

3. The skateboard holder of claim 2 wherein said means for interconnecting comprises a snap means.

4. The skateboard holder of claim 2 wherein said means for interconnecting comprises a buckle means.

5. The skateboard holder of claim 2 wherein said means for attachment to a belt comprises two spaced-apart vertical slits in said hanger.

6. The skateboard holder of claim 2 wherein said hanger, said first strap, and said second strap are formed of a single sheet of material.

7. The skateboard holder of claim 2 wherein said hanger is rectangularly shaped.

8. A skateboard holder comprising:

a hanger;

means for removably attaching said hanger to a belt;

a strap having first and second ends, said first end being wider than said second end, said first end being attached to one side of said hanger;

means for attaching said second end to the other side of said hanger, said strap thereby forming a loop for supporting said skateboard.

9. The skateboard holder of claim 8 wherein said means for attaching comprises snap means.

10. The skateboard holder of claim 8 wherein said means for attaching comprises buckle means.

* * * * *